US011196203B1

(12) United States Patent
Kim et al.

(10) Patent No.: US 11,196,203 B1
(45) Date of Patent: Dec. 7, 2021

(54) CONNECTOR ASSEMBLY INCLUDING RECEPTACLE CONNECTOR AND PLUG CONNECTOR

(71) Applicant: SENSORVIEW INCORPORATED, Gyeonggi-do (KR)

(72) Inventors: Byoung Nam Kim, Gyeonggi-do (KR); Kyoung Il Kang, Gyeonggi-do (KR); Joung Min Park, Gyeonggi-do (KR); Sung Cheol Cho, Incheon (KR); Sang Woo Han, Gyeonggi-do (KR)

(73) Assignee: SENSORVIEW INCORPORATED, Gyeonggi-do (KR)

( * ) Notice: Subject to any disclaimer, the term of this patent is extended or adjusted under 35 U.S.C. 154(b) by 0 days.

(21) Appl. No.: 17/130,047

(22) Filed: Dec. 22, 2020

(30) Foreign Application Priority Data

May 25, 2020 (KR) ..... 10-2020-0062337

(51) Int. Cl.
*H01R 13/24* (2006.01)
*H01R 13/422* (2006.01)
*H01R 13/6581* (2011.01)

(52) U.S. Cl.
CPC ..... *H01R 13/2471* (2013.01); *H01R 13/4226* (2013.01); *H01R 13/6581* (2013.01)

(58) Field of Classification Search
CPC ..... H01R 13/6581; H01R 13/6587; H01R 13/4226; H01R 13/2471
See application file for complete search history.

(56) References Cited

U.S. PATENT DOCUMENTS 7,648,394 B2 * 1/2010 Yotsutani ..... H01R 12/718 439/581
9,033,732 B2 * 5/2015 Hashiguchi ..... H01R 24/40 439/581
10,797,412 B2 * 10/2020 Barthelmes ..... H01R 13/6583
2001/0027033 A1 * 10/2001 Fujimoto ..... H01R 24/50 439/63

* cited by examiner

*Primary Examiner* — Briggitte R. Hammond
(74) *Attorney, Agent, or Firm* — Harness, Dickey & Pierce, P.L.C.

(57) ABSTRACT

A connector assembly according to the present invention includes a receptacle connector; and a plug connector to be slidably inserted into the receptacle connector, wherein the plug connector includes a signal pin having one side in electrical contact with a signal line of a cable, a shield can formed to enclose the signal pin so that a lower surface of the other side of the signal pin is exposed and to be electrically spaced apart from the signal pin, a first insulating member coupled to the signal pin to insulate between the signal pin and the shield can, and a plug shell enclosing the shield can so as to expose the lower surface of the other side of the signal pin.

13 Claims, 21 Drawing Sheets

CONNECTOR ASSEMBLY INCLUDING RECEPTACLE CONNECTOR AND PLUG CONNECTOR

CROSS-REFERENCE TO RELATED APPLICATION

This application claims the benefit under 35 USC § 119(a) of Korean Patent Application No. 10-2020-0062337, filed on May 25, 2020, in the Korean Intellectual Property Office, the entire disclosure of which is incorporated herein by reference for all purposes.

FIELD

The following description relates to a connector assembly, and more particularly, to a connector assembly including a receptacle connector and a plug connector to be slidably inserted into the receptacle connector.

BACKGROUND

In various types of electronic devices (e.g., wired/wireless communication devices), an internal circuit is implemented on a circuit board. A connector assembly including a receptacle connector and a plug connector is used to connect the circuit board to other electronic devices or other circuit boards. The receptacle connector is mounted on the circuit board, the plug connector is coupled to a cable, and the plug connector is coupled to the receptacle connector, so that the cable and the circuit board are electrically connected.

Since a conventional connector assembly has a structure in which a plug connector is vertically coupled to a receptacle connector on a circuit board, there are problems in that it is difficult to be reduced in size due to the height of the connector assembly and a coupling copper wire of the plug connector and it is disadvantageous in shielding electromagnetic waves. Also, it is difficult to simultaneously connect a plurality of cables and circuit boards with a single connector assembly.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An objective of the present invention is to provide a connector assembly that has a structure in which a plug connector is slidably inserted into a receptacle connector and is advantages in miniaturization by minimizing a height of the connector assembly and making a coupling copper wire of the plug connector parallel to a circuit board.

Also, another objective of the present invention is to provide a connector assembly having excellent electromagnetic wave shielding performance and capable of simultaneously connecting a plurality of cables and circuit boards.

The objectives to be achieved by the present invention are not limited to the foregoing, and additional objectives, which are not mentioned herein, will be readily understood by those skilled in the art from the following description.

In one general aspect, there is provided a connector assembly including a receptacle connector and a plug connector to be slidably inserted into the receptacle connector, wherein the plug connector includes a signal pin having one side in electrical contact with a signal line of a cable, a shield can formed to enclose the signal pin so that a lower surface of the other side of the signal pin is exposed and to be electrically spaced apart from the signal pin, a first insulating member coupled to the signal pin to insulate between the signal pin and the shield can, and a plug shell enclosing the shield can so as to expose the lower surface of the other side of the signal pin, and wherein the receptacle connector includes a clip pin having a lower portion formed to be in contact with a signal pad of a circuit board and an upper end formed to be in elastic contact with the lower surface of the other side of the signal pin, a receptacle base formed to be installed on the circuit board and providing a space in which the clip pin is accommodated, a second insulating member enclosing lateral surfaces of the clip pin to insulate between the clip pin and the receptacle base, and a receptacle shell covering the receptacle base to provide a space into which the plug connector is slidably inserted together with the receptacle base.

The shield can may include a lower shield can having a seating groove in which a lower portion of the cable is seated and an upper shield can having a seating groove in which an upper portion of the cable is seated and covering the lower shield can.

The signal pin may be provided in plural and arranged in parallel corresponding to a plurality of cables and the shield can may include a shielding wall to shield between adjacent signal pins.

The signal pin may include a first portion having an insertion portion into which the signal line is inserted on one side and a second portion integrally formed with the first portion and having the lower surface of the other side.

The first insulating member may have a through hole through which the second portion of the signal pin passes, and may include a first section formed to cover an upper portion of the second portion and expose the lower surface of the other side while forming an upper portion of the through hole and a second section formed below the first section to be shorter than the first section to expose the lower surface of the other side while forming a lower portion of the through hole.

The shield can may include a lower shield can having a seating groove in which a lower portion of the cable is seated and a seating groove in which the first insulating member and the second insulating member are seated, and an upper shield can covering the lower shield can and having a seating groove in which an upper portion of the cable is seated and a seating groove in which the first section of the first insulating member is seated.

The plug shell, the receptacle base, and the receptacle shell may be formed of a metal material.

The plug shell may include a wrapping portion that encloses and supports a portion of the cable exposed to the outside of the shield can.

The plug shell may have a coupling hole on an upper surface thereof and the receptacle shell may have an elastic coupling portion, on an upper surface thereof, to be inserted into and coupled to the coupling hole.

The receptacle shell may have a coupling hole on a lateral surface thereof and the plug shell may have a coupling projection, on a lateral surface thereof, to be inserted into and coupled to the coupling hole.

The plug shell may have a plurality of protruding portions on a lower surface thereof and the plurality of protruding portions may be in close contact with an upper surface of the receptacle base.

The second insulating member may have holes on both lateral surfaces thereof and the clip pin has protruding portions, on both lateral surfaces thereof, to be inserted into the holes.

The receptacle base may have a space into which the second insulating member is inserted, the second insulating member may have a protruding portion on a lateral surface thereof, and a receiving groove in which the protruding portion is accommodated may be formed on a lateral side of the space.

Other features and aspects will be apparent from the following detailed description, the drawings, and the claims.

Figure 1A:
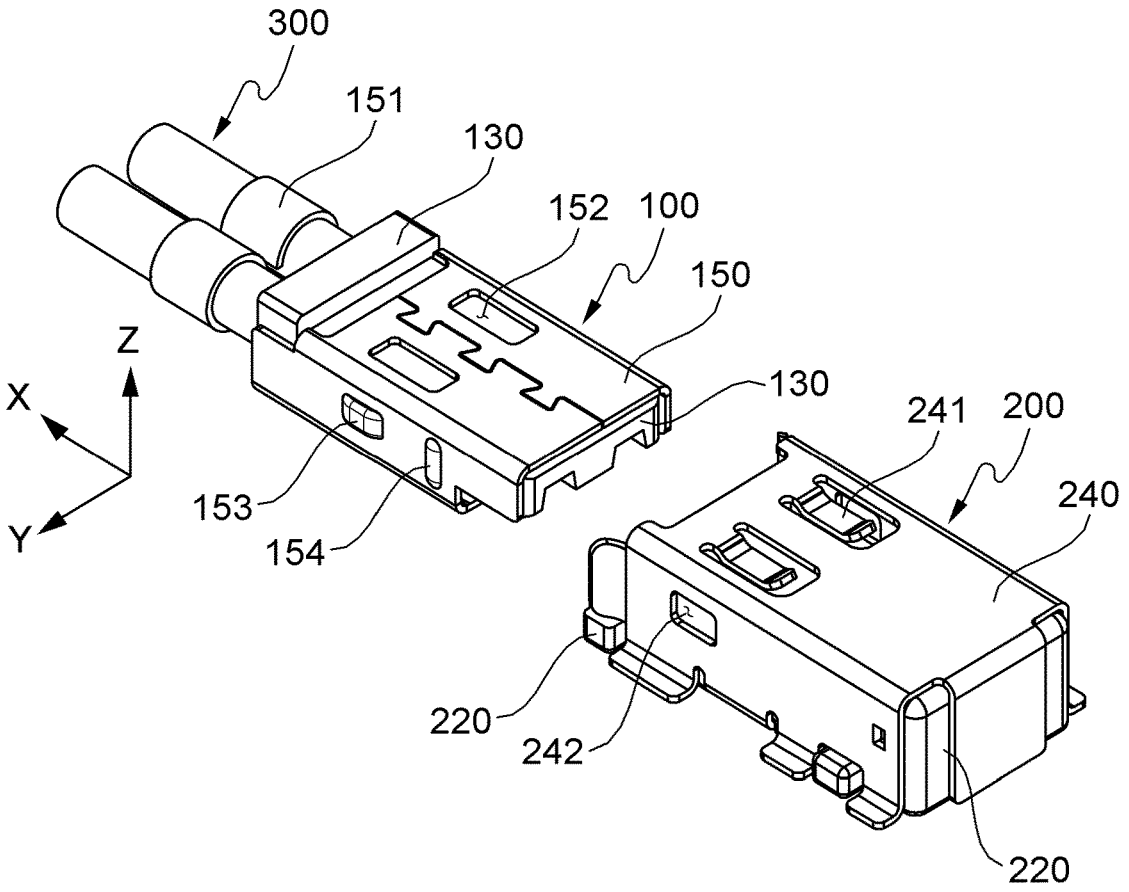
FIG. 1A is a perspective view of one side of a connector assembly according to an embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 1B:
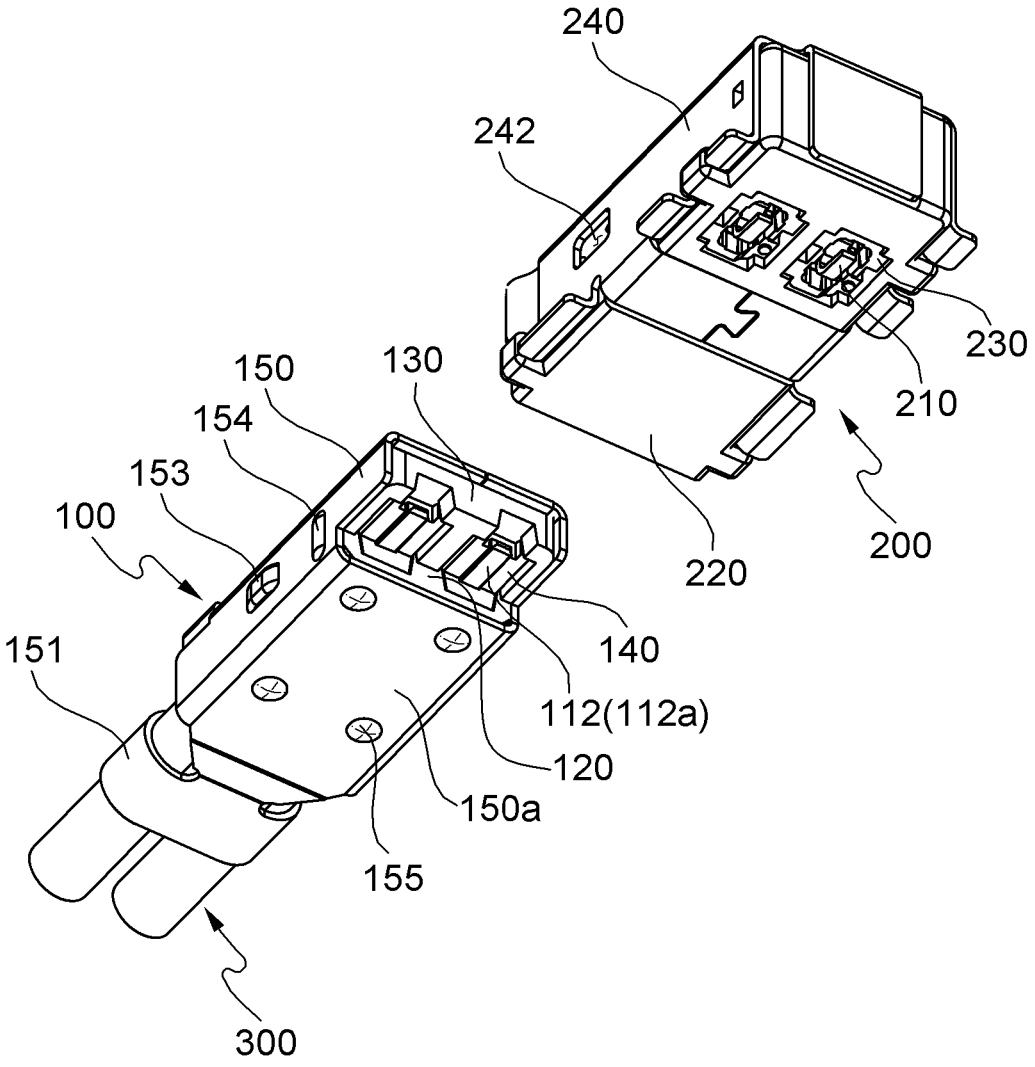
FIG. 1B is a perspective view of the connector assembly of FIG. 1A as viewed from another side.
Figure 1C:
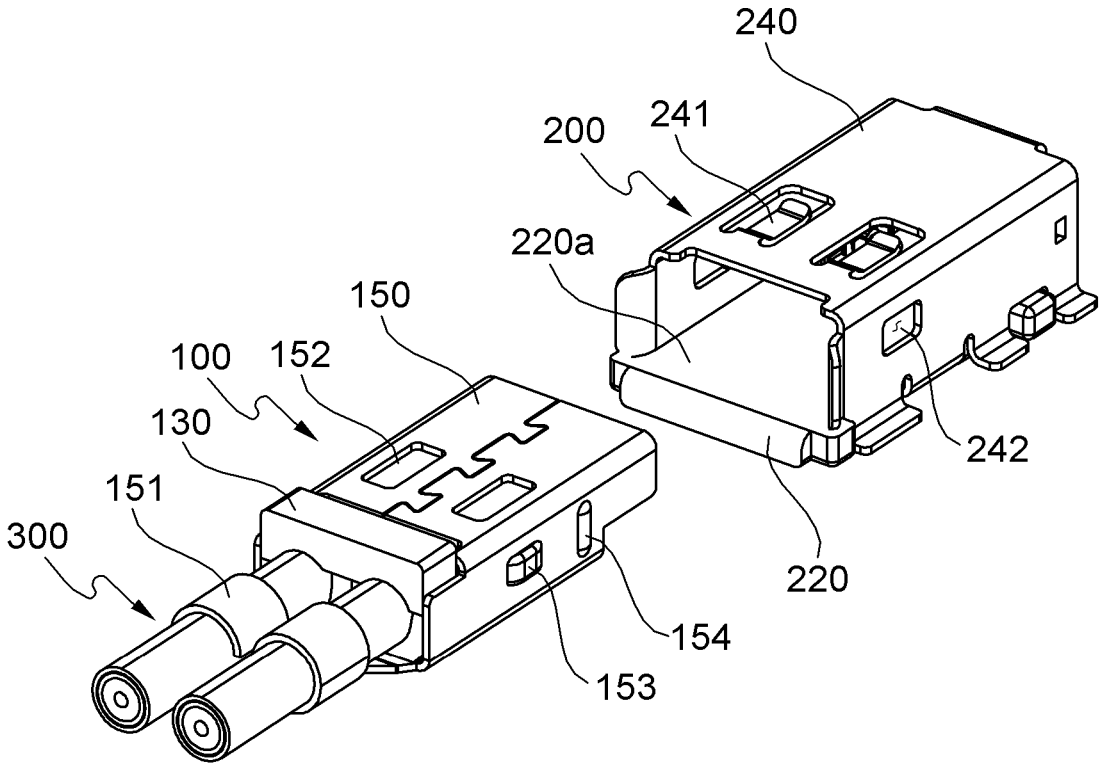
FIG. 1C is a perspective view of the connector assembly of FIG. 1A as viewed from still another side.

FIGS. 1A to 1C are views showing a connector assembly according to an embodiment of the present invention. In this specification, for convenience of illustration, an X-axis direction is defined as a front side (or a front surface or a front end), a negative X-axis direction is defined as a rear side (or a rear surface or a rear end), a Z-axis direction is defined as an upper side (or an upper surface or an upper end), a negative Z-axis direction is defined as a lower side (or a lower surface or a lower end), and a Y- and negative Y-axis directions are defined as lateral sides. FIG. 1A is a perspective view of a connector assembly as viewed from a rear upper side, FIG. 1B is a perspective view of the connector assembly as viewed from a rear lower side, and FIG. 1C is a perspective view of the connector assembly as viewed from a front upper side.

The connector assembly according to the present embodiment includes a receptacle connector 200 mounted on a circuit board (reference P in FIG. 6C), and a plug connector 100 to be coupled to a cable 300 and slidably inserted into the receptacle connector 200.

The receptacle connector 200 may be mounted on the circuit board P by a surface mounting (surface mount device (SMD)/surface mount technology (SMT)) method, a single in-line package (SIP) method, a dual in-line package (DIP) method, and a quad in-line package (QIP) method, or may be mounted by selectively using the surface mounting method and a penetration method. Depending on an embodiment, the receptacle connector 200 may not be a separate component but may be integrally formed with the circuit board P.

The receptacle connector 200 may have a shape in which the front is opened and the rear is closed so that the plug connector 100 can be slidably inserted from the front.

Figure 2A:
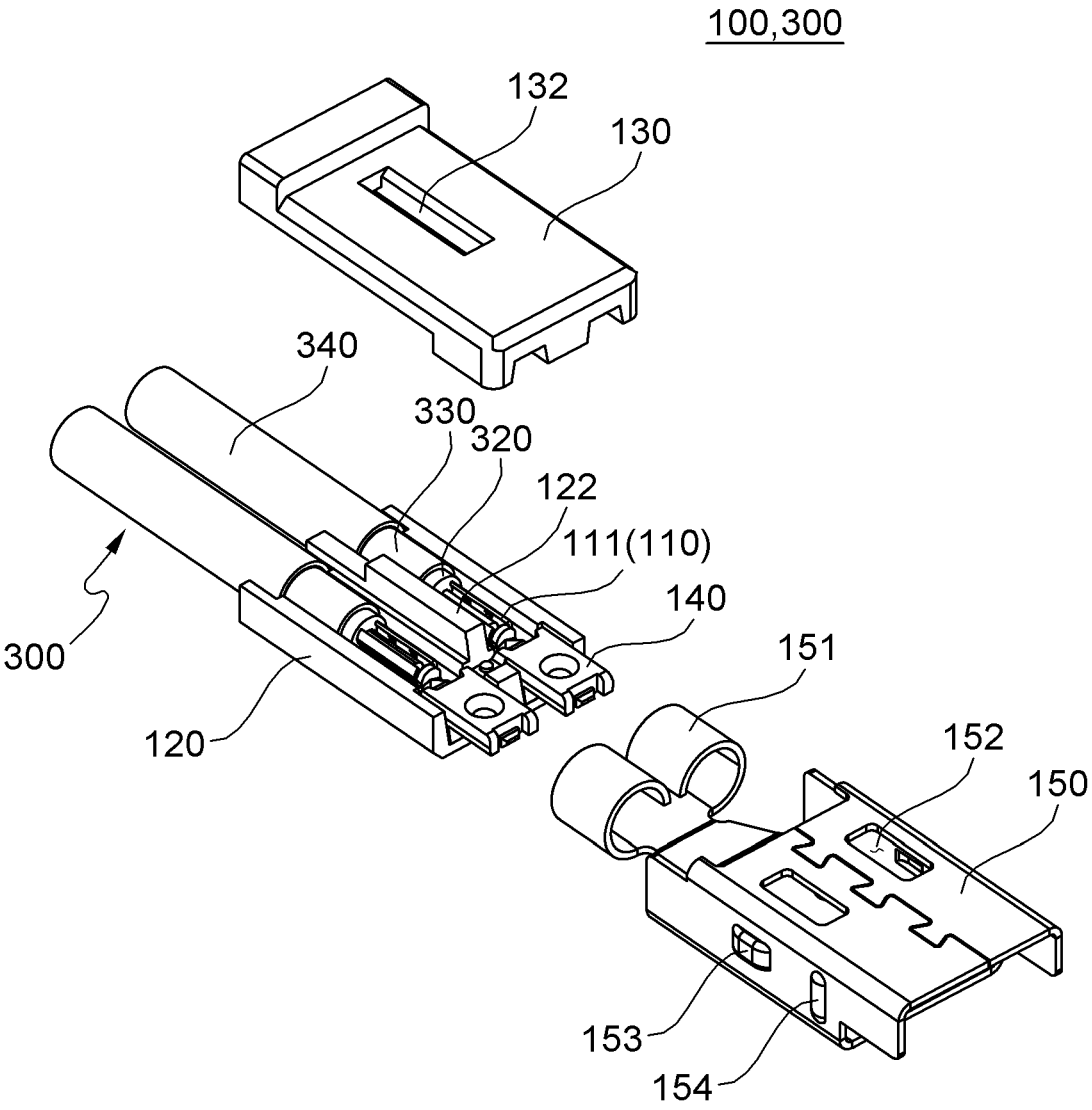
FIG. 2A is a first exploded view of a plug connector according to an embodiment of the present invention.
Figure 2B:
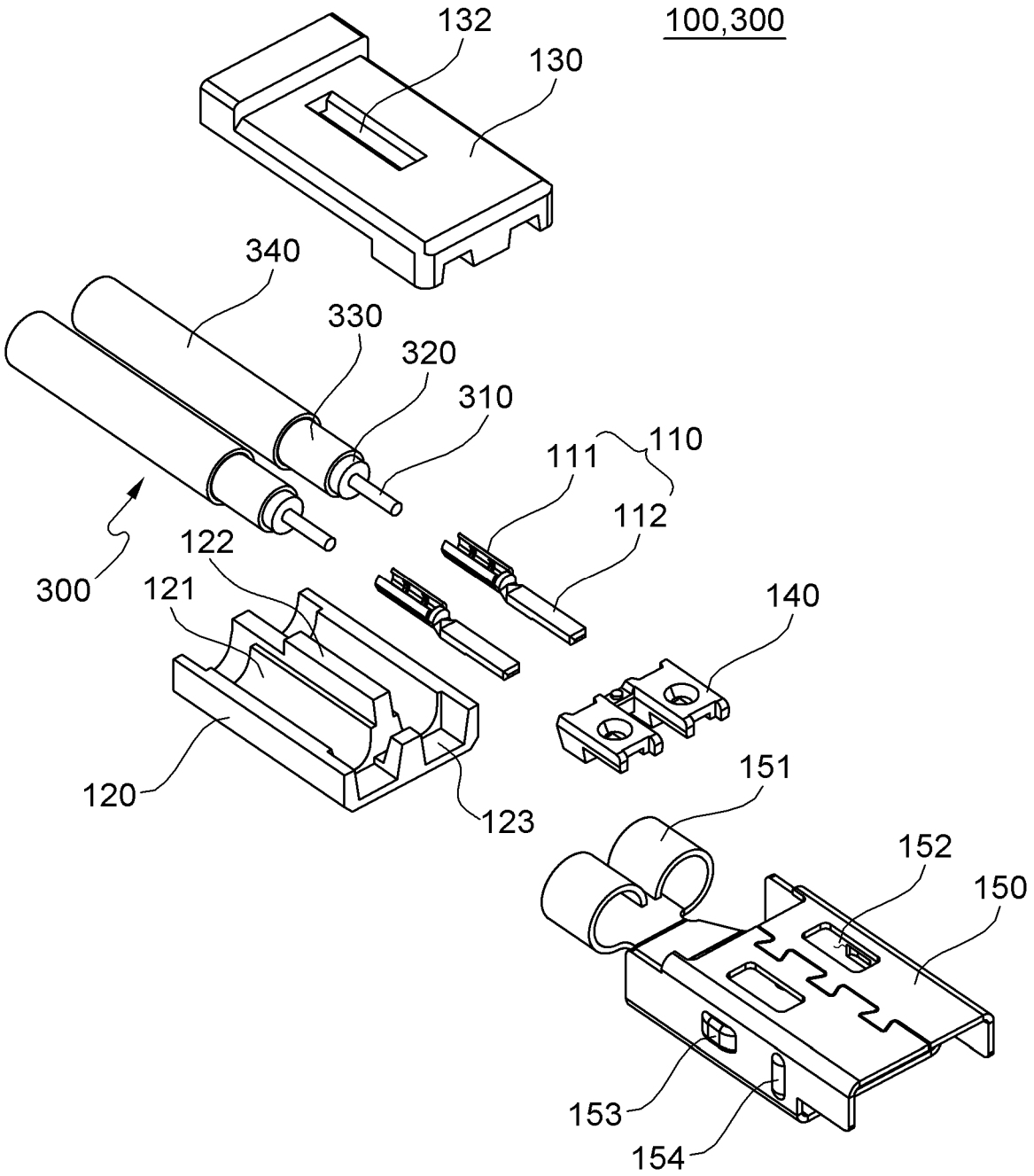
FIG. 2B is a second exploded view of a plug connector according to an embodiment of the present invention.
Figure 2C:
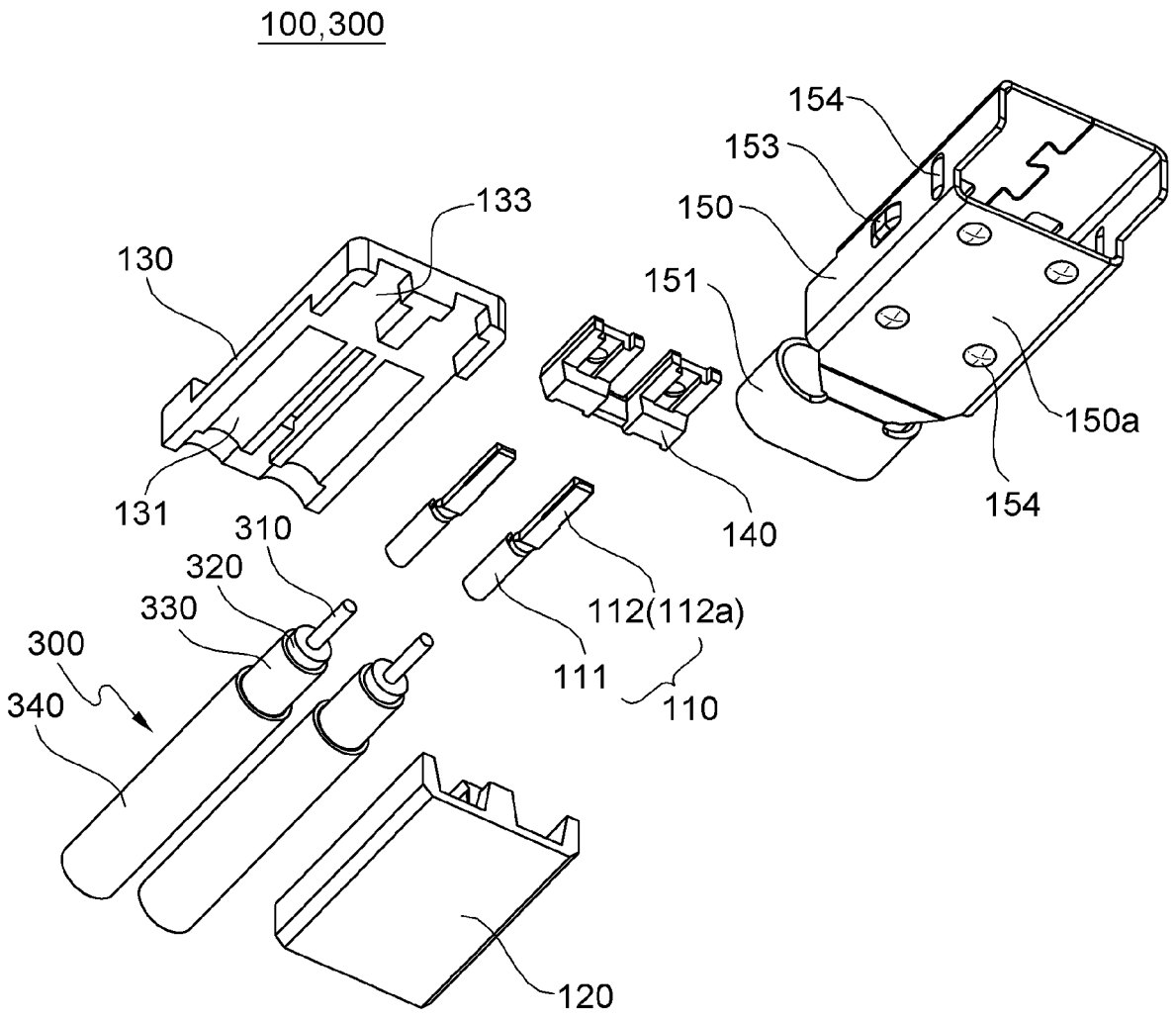
FIG. 2C is the second exploded view of the plug connector of FIG. 2B as viewed from another side.

FIGS. 2A to 2C are views of the plug connector 100 according to an embodiment of the present invention. FIG. 2A is a first exploded view as viewed from a rear upper side of the plug connector 100, FIG. 2B is a second exploded view as viewed from a rear upper side of the plug connector 100, and FIG. 2C is the second exploded view as viewed from a rear lower side of the plug connector 100 of FIG. 2B.

In the present embodiment, a coaxial cable is described as an example of the cable 300 coupled to the plug connector 100, but the cable 300 may be various types of cables, such as a data cable, a wire, a flexible flat cable (FFC), a flexible printed circuit (FPC), or the like, instead of a coaxial cable.

The cable 300 may include a signal line (internal conductor) 310, an outer conductor 330 that shields electromagnetic waves of the signal line 310 and is made of aluminum, copper, or the like, a dielectric material 320 that insulates and separates the signal line 310 and the external conductor 330, and a sheath (jacket) 340 that protects the outer conductor 330.

The plug connector 100 includes a signal pin 110, shield cans 120 and 130, a first insulating member 140, and a plug shell 150.

In the present embodiment, the number of cables 300 is described as two, but the number of cables 300 may be one or three or more. When there are a plurality of cables 300, the cables 300 are disposed in parallel with each other. Those skilled in the art will understand that the number or structure of the signal pins 110, the shield cans 120 and 130, the first insulating members 140, and the plug shells 150 may be appropriately modified according to the number of cables 300.

The signal pin 110 is formed so that a front side thereof is in electrical contact with the signal line 310 of the cable 300 and a lower surface 112*a* of a rear side thereof is in elastic contact with an upper end of the clip pin 210 of the receptacle connector 200 which will be described below. The signal pin 110 is provided for each cable 300, and when there are a plurality of cables 300, the plurality of signal pins 110 are also arranged in parallel with each other.

The signal pin 110 may include a first portion 111 on the front side thereof and a second portion 112 formed integrally with the first portion 111 on the rear side thereof. The first portion 111 may be provided with an insertion portion into which the signal line 310 is inserted. The first portion 111 of the signal pin 110 and the signal line 310 may be in electrical contact with each other via a constriction, soldering, or the like. One or more protrusions may be formed on the inside of a first portion 111 of the signal pin 110 to improve a tensile force for fixing the signal line 310. The second portion 112 has a lower surface 112*a* that is in elastic contact with the upper end of the clip pin 210 of the receptacle connector 200.

The shield cans 120 and 130 enclose the signal pin 110 so that the lower surface 112*a* of the second portion 112 of the signal pin 110 is exposed, and they are formed to be electrically spaced apart from the signal pin 110. The shield cans 120 and 130 may be formed of a metal material to shield electromagnetic waves. The shied cans 120 and 130 may include a lower can 120 and an upper shield can 120 and a lower shield can 130. The lower shield can 120 may include a seating groove 121 in which a lower portion of the cable 300 is seated. The upper shield can 130 may be formed to cover the lower shield can 120 and may include a seating groove 131 in which an upper portion of the cable 300 is seated. In the present embodiment, the shield cans 120 and 130 are described as being formed by coupling the lower shield can 120 and the upper shield can 130, but the shield cans 120 and 130 may be integrally formed.

The lower shield can 120 may include a shielding wall 122 that shields between adjacent signal pins 110. In addition, the upper shield can 130 may include a hole 132 into which an upper portion of the shielding wall 122 is inserted. Depending on an embodiment, the shielding wall that shields between the adjacent signal pins 110 may be included in the upper shield can 130 instead of the lower shield can 120.

The first insulating member 140 is coupled to the rear side of the signal pin 110, specifically, the second portion 112 of the signal pin 110 to insulate between the signal pin 110 and the shield cans 120 and 130.

Figure 3A:
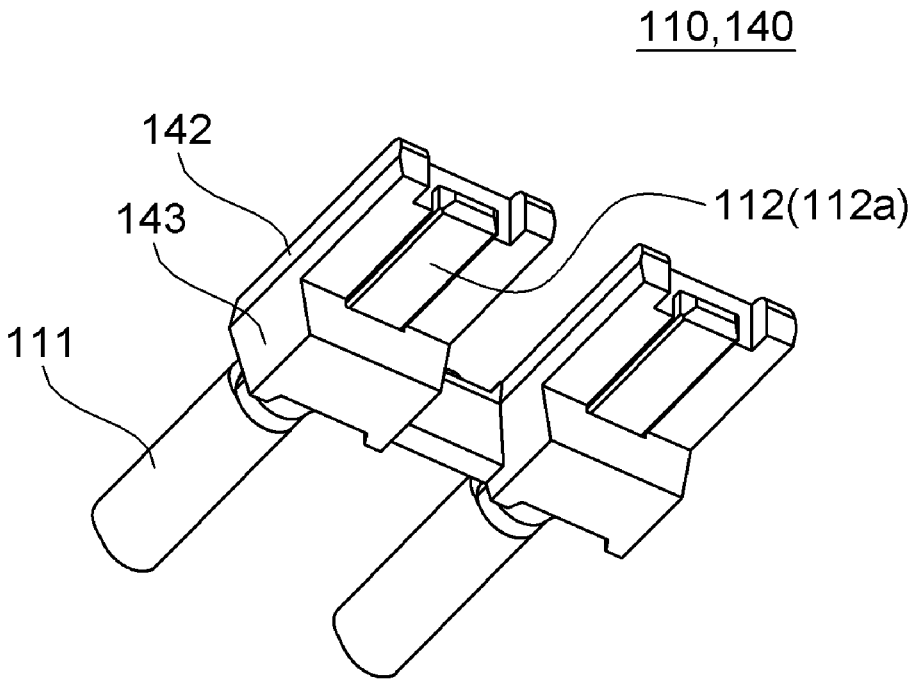
FIG. 3A is a perspective view of a signal pin of a plug connector and a first insulating member according to an embodiment of the present invention as viewed from one side.
Figure 3B:
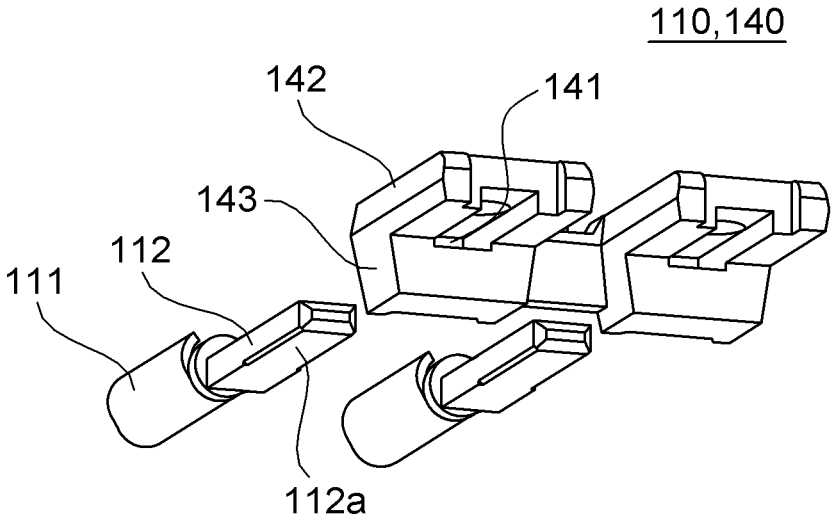
FIG. 3B is a perspective view showing that the signal pin and the first insulating member of FIG. 3A are separated from each other.
Figure 3C:
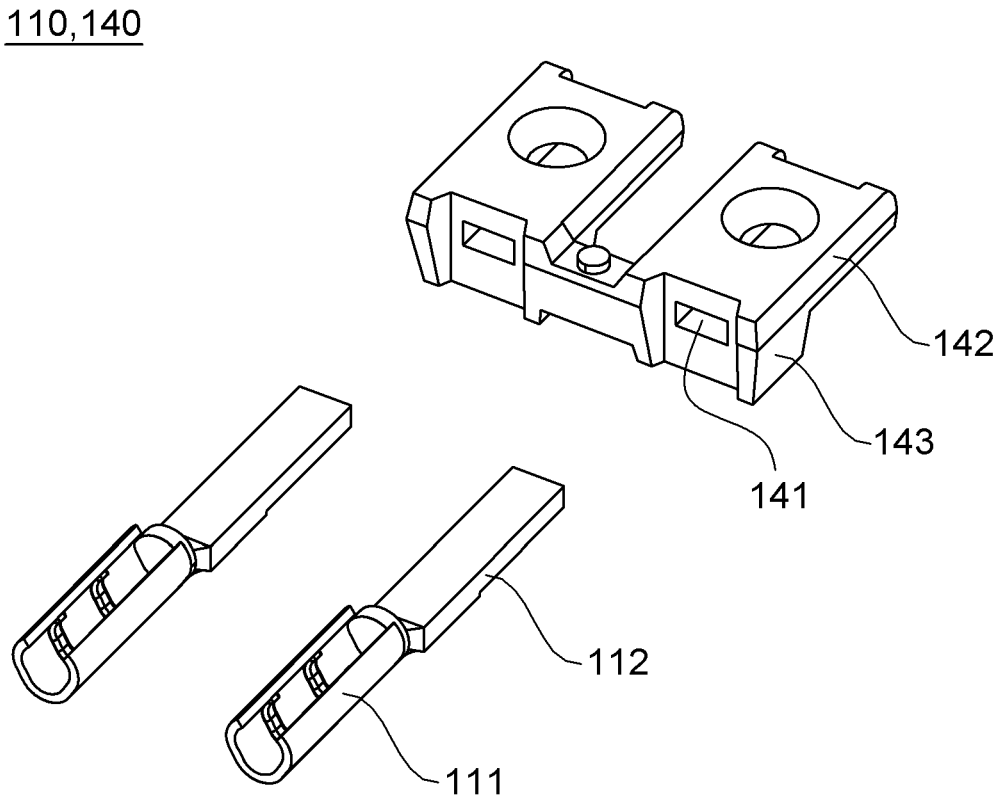
FIG. 3C is a perspective view of the signal pin and the first insulating member of FIG. 3B as viewed from another side.

FIGS. 3A to 3C are perspective views showing in detail the signal pin 110 and the first insulating member 140. FIG. 3A is a perspective view of the first pin 110 and the first insulating member 140 as viewed from the rear side, FIG. 3B is a perspective view showing that the signal pin 110 and the first insulating member 140 are separated from each other, and FIG. 3C is a perspective of the signal pin 110 and the first insulating member 140 of FIG. 3B as viewed from the front upper side.

The first insulating member 140 may include a through hole 141 through which the second portion 112 of the signal pin 110 passes, and may include a first section 142 and a second section 143 formed integrally with the first section 142. The through hole 141, the first section 142, and the second section 143 are provided for each signal pin 110. The first section 142 may form an upper portion of the through hole 141 and be elongated in a length direction of the second portion 112 of the signal pin 110 so as to cover the upper portion of the second portion 112 and expose the lower surface 112*a* of the second portion 112. The second section 143 may be formed below the first section 142 to be shorter than the first section 142 in the length direction of the second portion 112 of the signal pin 110 to expose the lower surface 112*a* of the second portion 112 while forming a lower portion of the through hole 141.

The lower shield can 120 may include a seating groove 123 in which the second section 143 of the first insulating member 140 is seated. In addition, the upper shield can 130 may include a seating groove 133 in which the first section 142 of the first insulating member 140 is seated.

The plug shell 150 may enclose the upper surfaces, lower surfaces, and both lateral surfaces of the shield cans 120 and 130 (specifically, the upper surface and both lateral surfaces of the upper shield can 130 and the lower surface and both lateral surfaces of the lower shield can 120) so that the lower surface 112*a* of the second portion 112 of the signal pin 110 is exposed.

The plug shell 150 may be formed of a metal material to shield electromagnetic waves. In addition, the plug shell 150 may include a wrapping portion 151 that surrounds and supports a portion of the cable 300 exposed to the outside of the shield cans 120 and 130 in front of the shield cans 120 and 130. The wrapping portion 151 may extend toward the front direction from the bottom of the plug shell 150. The wrapping portion 151 may prevent damage due to excessive bending or dislodging of the cable 300.

According to the plug connector 100 according to an embodiment of the present invention, electromagnetic waves generated through the signal line 310 and the outer conductor 330 of the cable 300 and the signal pin 110 are primarily shielded by the shield cans 120 and 130 and secondarily shielded by the plug shell 150, thus improving electromagnetic wave shielding performance. In addition, since electromagnetic waves between adjacent signal lines 310 or between adjacent signal pins 110 are shielded by the shielding walls 122 in the shield cans 120 and 130, interference between signals can be minimized.

Figure 4A:
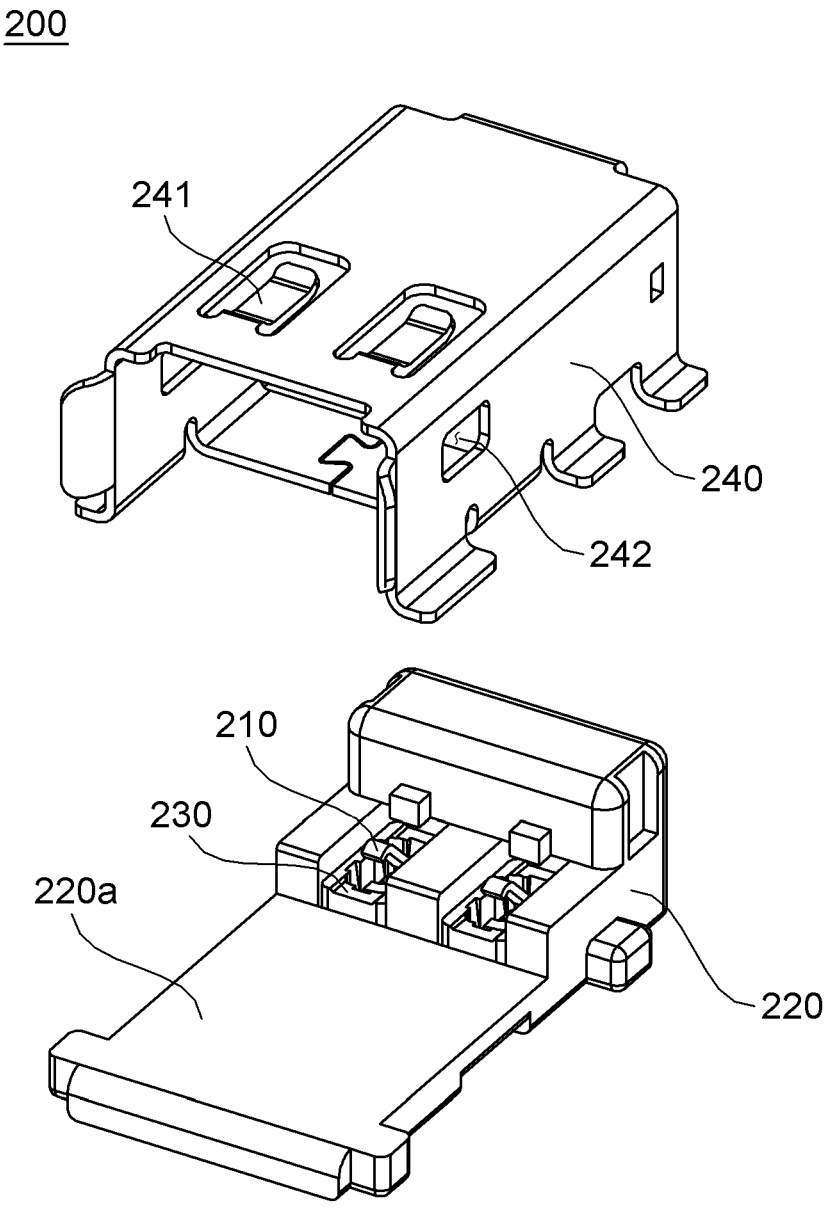
FIG. 4A is a first exploded view of a receptacle connector according to an embodiment of the present invention.
Figure 4B:
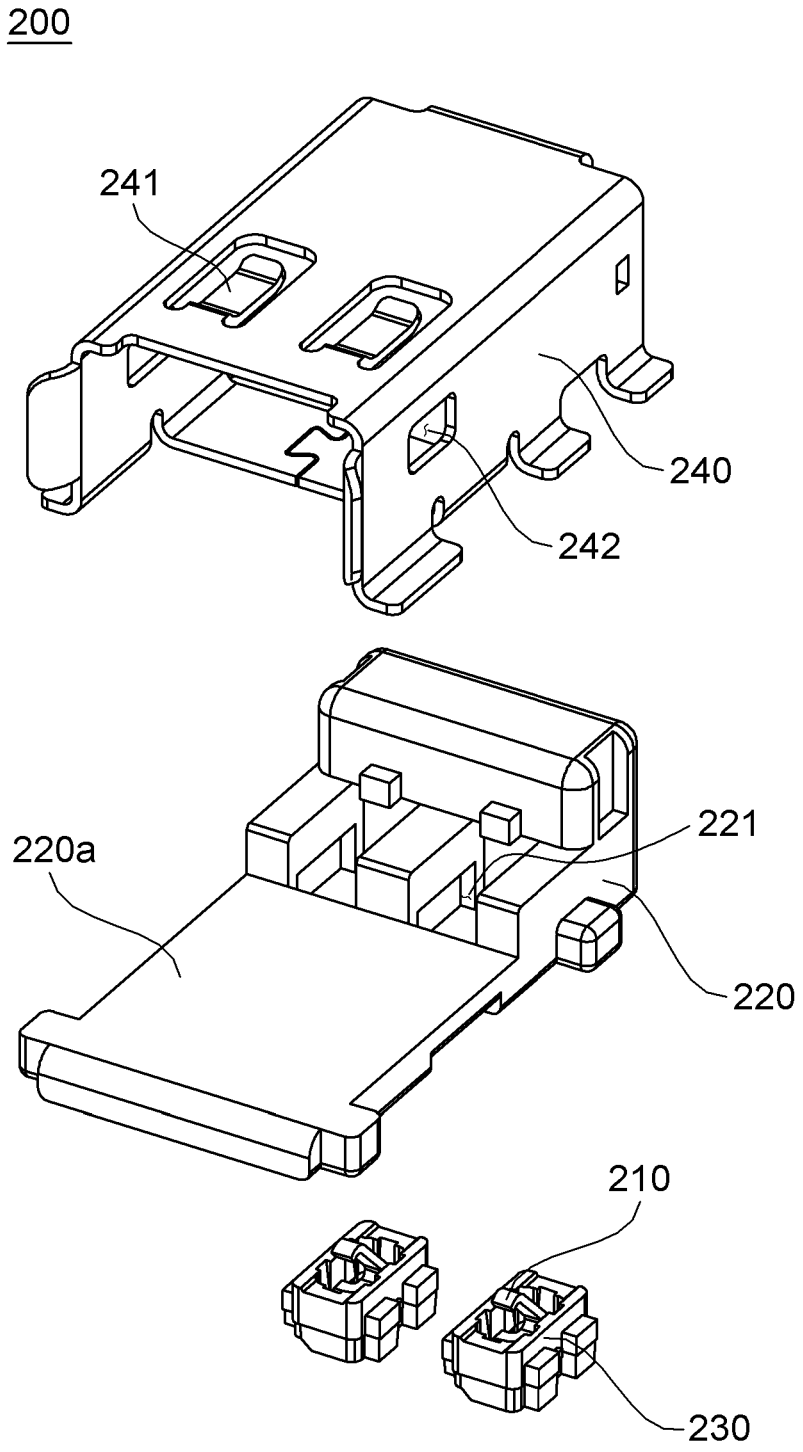
FIG. 4B is a second exploded view of a receptacle connector according to an embodiment of the present invention.
Figure 4C:
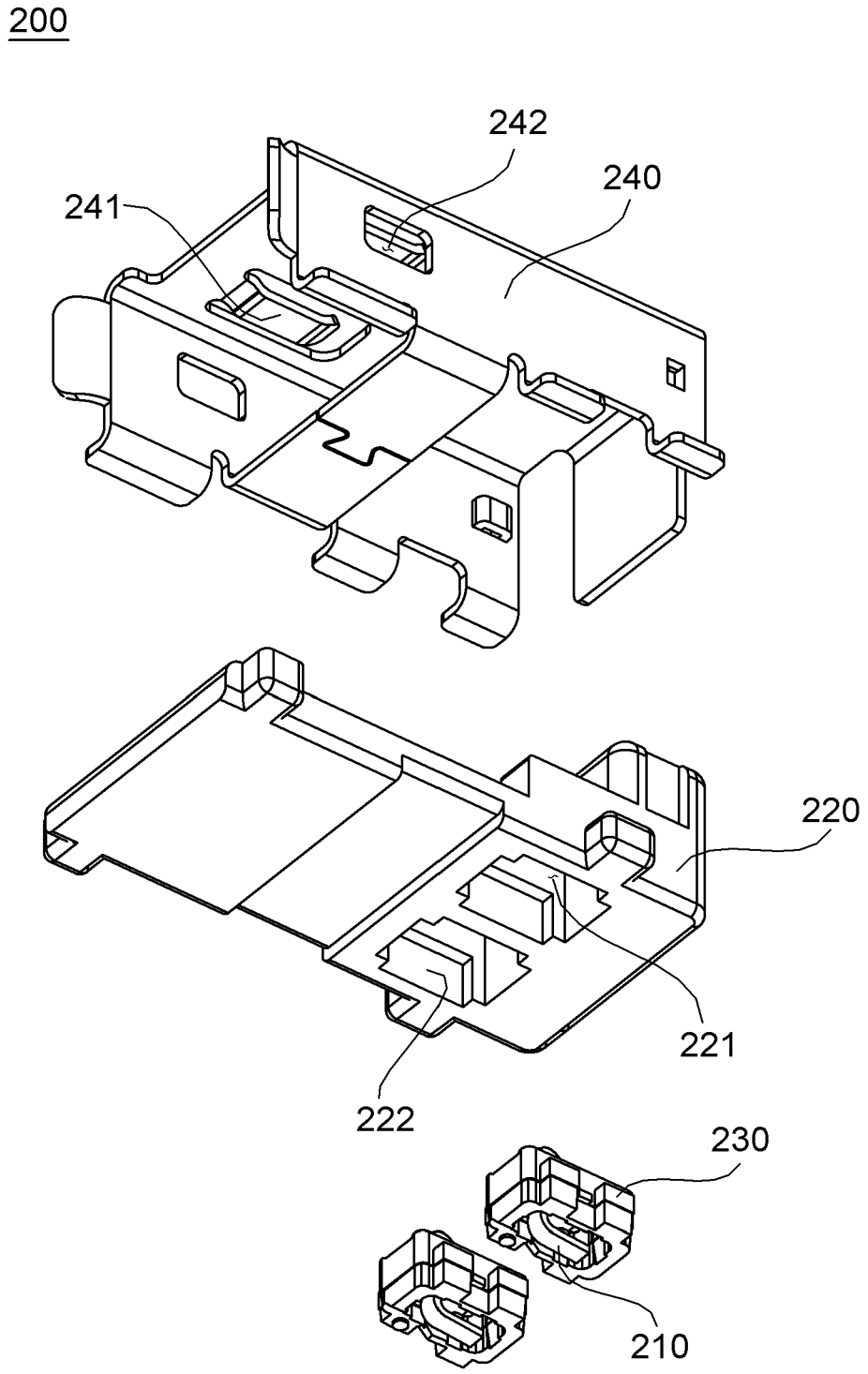
FIG. 4C is the second exploded view of the receptacle connector of FIG. 4B viewed from another side.

FIGS. 4A to 4C are views of a receptacle connector according to an embodiment of the present invention. FIG. 4A is a first exploded view of the receptacle connector 200 as viewed from a front upper side, FIG. 4B is a second exploded view of the receptacle connector 200 as viewed from the front upper side, and FIG. 4C is the second exploded view of the receptacle connector 200 of FIG. 4B as viewed from a front lower side.

The receptacle connector 200 includes a clip pin 210, a receptacle base 220, a second insulating member 230, and a receptacle shell 240.

The clip pin 210 is formed so that a lower surface thereof is in electrical contact with a signal pad (not shown) of the circuit board (reference P in FIG. 6C) via elastic contact or soldering and an upper end thereof is in elastic contact with the lower surface 112*a* of the second portion 112 of the signal pin 110. According to an embodiment, the clip pin 210 may be in electrical contact with the signal pad of the circuit board P by a surface mounting (SMD/SMT) method, an SIP method, which is a penetration method, a DIP method, a QIP method, or the like. When there are a plurality of signal pins 110, a plurality of clip pins 210 are also provided respectively for the signal pins 110 and are arranged according to the arrangement of the signal pins 110.

The receptacle base 220 is formed to be installed on the upper surface of the substrate P, and provides a space 221 in which the second insulating member 230 and the clip pin 210 are accommodated. The space 221 may be formed to penetrate through the top and bottom of the receptacle base 220.

The second insulating member 230 is inserted into the space 221 of the receptacle base 220 and encloses the lateral surfaces of the clip pin 210 to fix the clip pin 210 and at the same time insulate between the clip pin 210 and the receptacle base 220.

The receptacle shell 240 covers the receptacle base 220 to provide a space into which the plug connector 100 is slidably inserted together with the receptacle base 220. That is, the plug connector 100 is slidably inserted into a space defined by an upper surface 220*a* of the receptacle base 220 and an inner upper surface and both inner lateral surfaces of the receptacle shell 240.

The receptacle base 220 and the receptacle shell 240 may be formed of a metal material to shield electromagnetic waves. Accordingly, in a state in which the plug connector 100 is coupled to the receptacle connector 200, electromagnetic waves generated through the signal line 310, the outer conductor 330, and the signal pin 110 are primarily shielded by the shield cans 120 and 130, secondarily shielded by the plug shell 150, and tertiarily shielded by the receptacle base 220 and the receptacle shell 240.

In order to securely connect the plug connector 100 and the receptacle connector 200, the plug shell 150 may have a coupling hole 152 on the upper surface, and the receptacle shell 240 may have an elastic coupling portion 241, on an upper surface thereof, to be inserted into and coupled to the coupling hole 152. In addition, the receptacle shell 240 may have coupling holes 242 on both lateral surfaces thereof, and the plug shell 150 may have coupling projections 153, on both lateral surfaces thereof, to be inserted into and coupled to the coupling holes 242. In addition, the plug shell 150 may have projections 154 formed on both lateral surfaces thereof and the projections 154 may be in close contact with both inner lateral surfaces of the receptacle shell 240. Also, the plug shell 150 may have a plurality of protruding portions 155 on a lower surface 150*a* thereof (e.g., at four points on both front and rear lateral sides) and the protruding portions 155 may be in close contact with the upper surface 220*a* of the receptacle base 220.

Figure 5:
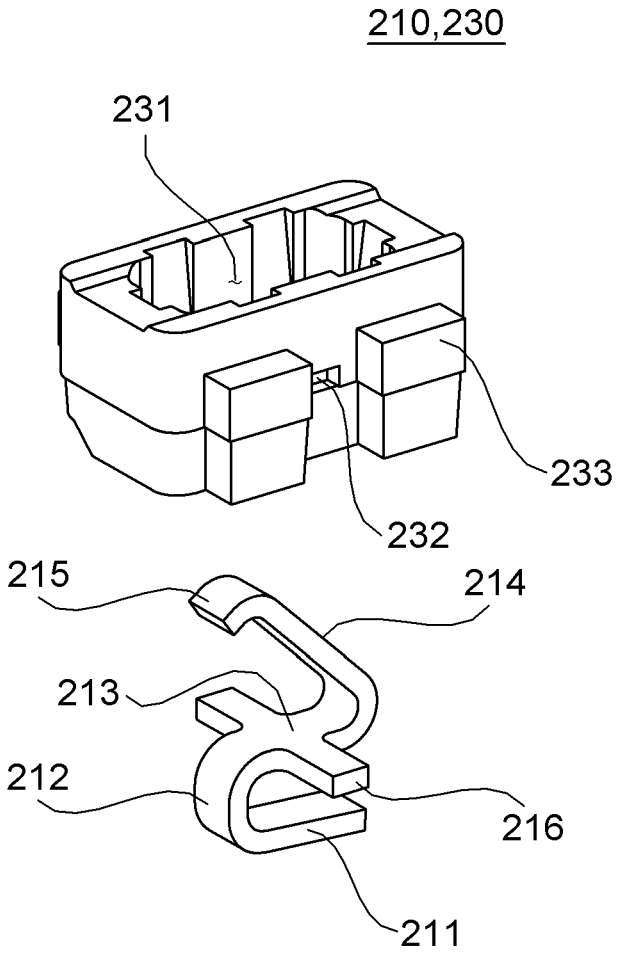
FIG. 5 is a perspective view showing that a clip pin of a receptacle connector and a second insulating member according to an embodiment of the present invention are separated from each other.

FIG. 5 is a view showing that the clip pin 210 of the receptacle connector 200 and the second insulating member 230 are separated from each other.

The clip pin 210 may include a first section 211 having a lower surface in contact with the signal pad of the circuit board P, a second section 212 extending substantially upward from a front end of the first section 211, a third section 213 extending substantially rearward from an upper end of the second section 212, a fourth section 214 extending obliquely forward and upward from a rear end of the third section 213, and a fifth section 215 extending obliquely forward and downward from an upper end of the fourth section 214. The lower surface of the first section 211 is in elastic contact with the signal pad of the circuit board P, and the upper end of the clip pin 210, that is, a portion between the fourth section 214 and the fifth section 215, is in elastic contact with the lower surface 112*a* of the second portion 112 of the signal pin 110. According to an embodiment, the lower surface of the first section 211 of the clip pin 210 may be in electrical contact with the signal pad of the circuit board P by a surface mounting (SMD/SMT) method, an SIP method, which is a penetration method, a DIP method, a QIP method, or the like. In the present embodiment, the clip pin 210 is disposed so that the fifth section 215 faces forward, but the clip pin 210 may be disposed so that the fifth section 215 faces rearward.

The second insulating member 230 may have a through hole 231 vertically penetrating therethrough to accommodate the clip pin 210. In addition, the second insulating member 230 may have holes 232 on both lateral surfaces thereof and the clip pin 210 may have protruding portions 216 formed on both lateral surfaces thereof and extending from the third section 213, so that the clip pin 210 can be fixed to the second insulating member 230 as the protruding portions 216 are inserted into the holes 232. The second insulating member 230 may have protruding portions 233 formed on both lateral surfaces thereof, and receiving grooves 222 in which the protruding portions 233 are accommodated may be formed on both lateral sides of the space 221 of the receptacle base 220 in which the second insulating member 230 is inserted.

Figure 6A:
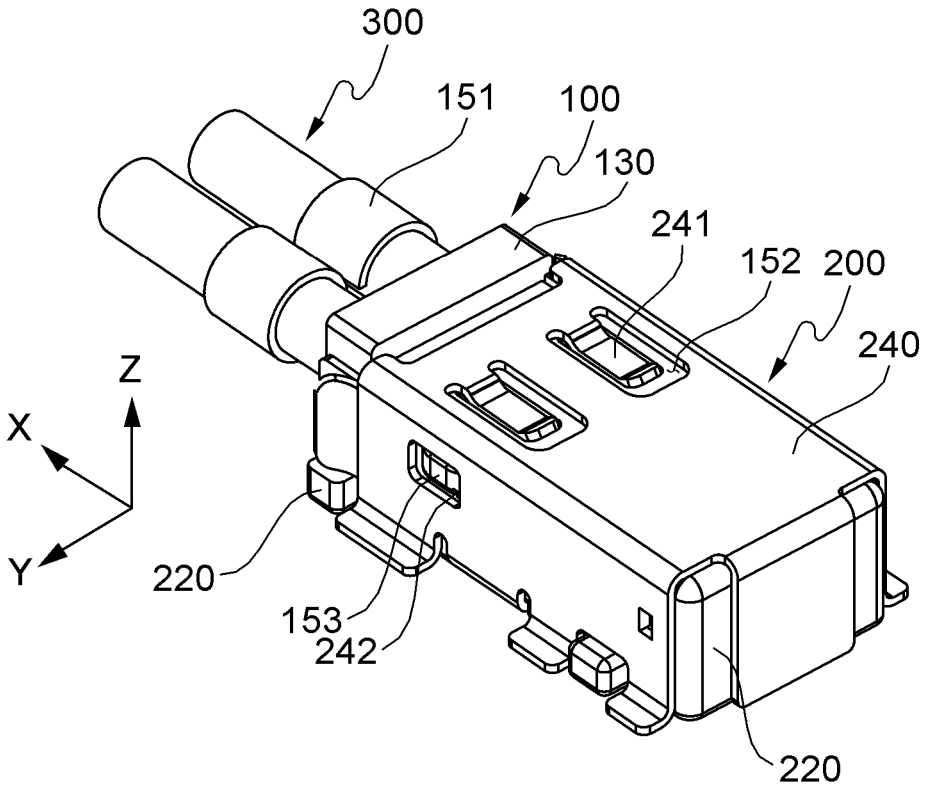
FIG. 6A is a perspective view of one side of a connector assembly in which a plug connector and a receptacle connector are coupled to each other.
Figure 6B:
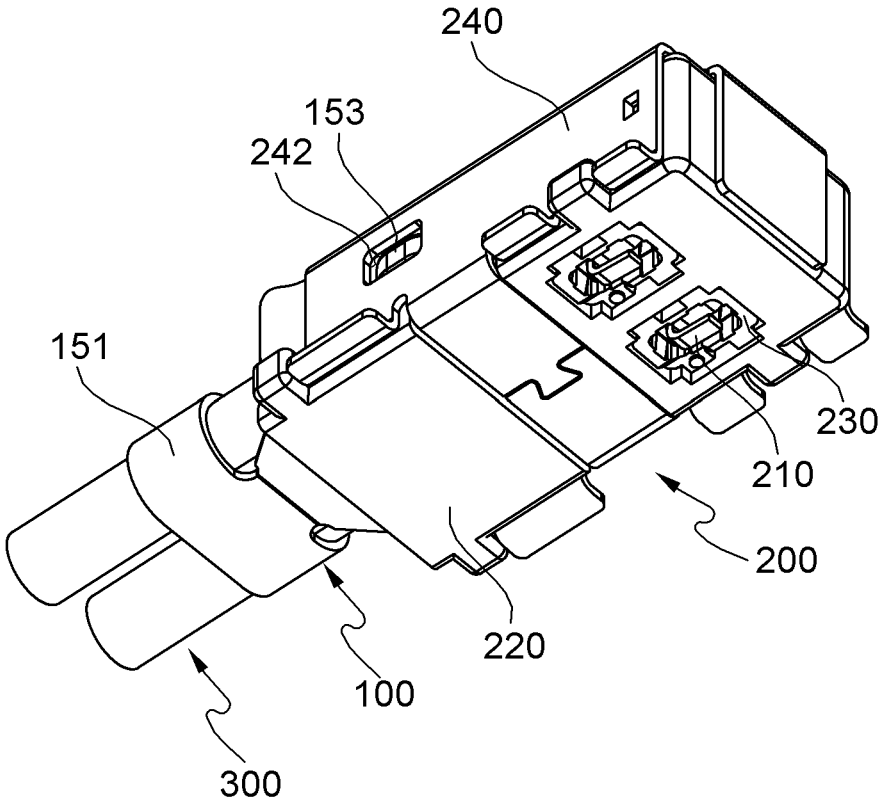
FIG. 6B is a perspective view of another side of the connector assembly of FIG. 6A.
Figure 6C:
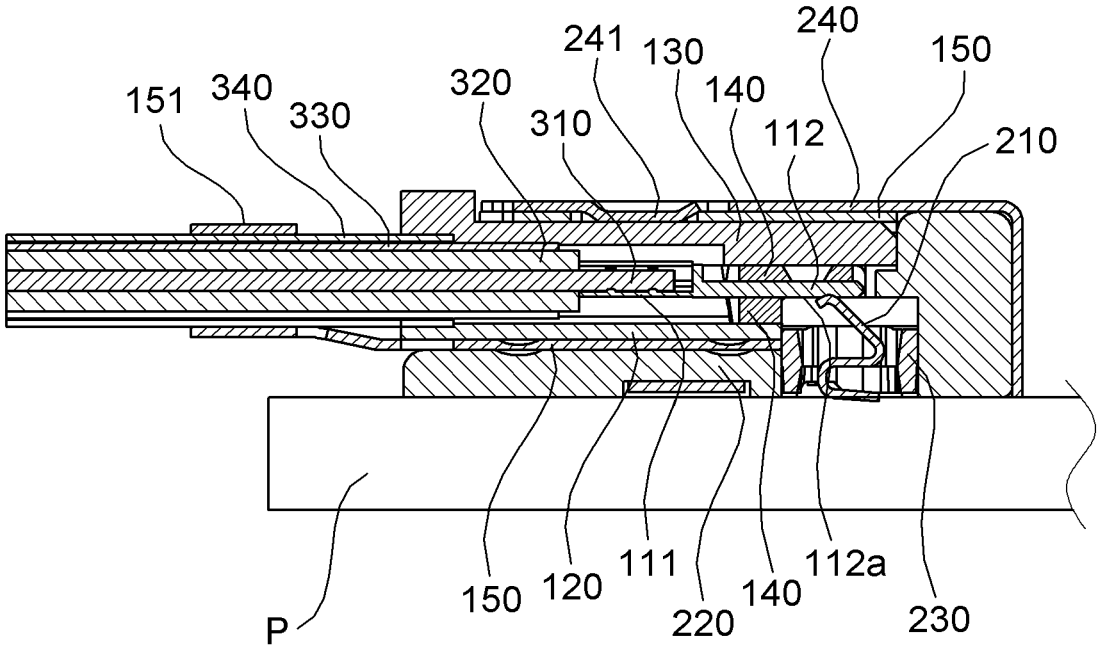
FIG. 6C is a cross-sectional view of the connector assembly in which the plug connector and the receptacle connector are coupled to each other.

FIGS. 6A to 6C are views of the connector assembly in which the plug connector 100 and the receptacle connector 220 are coupled to each other. FIG. 6A is a perspective view of the connector assembly in which the plug connector 100 and the receptacle connector 200 are coupled to each other as viewed from the rear upper side, FIG. 6B is a perspective view of the connector assembly in which the plug connector 100 and the receptacle connector 200 are coupled to each other as viewed from the rear lower side, and FIG. 6C is a cross-sectional view of the connector assembly in which the plug connector 100 and the receptacle connector 200 are coupled to each other.

Referring to FIG. 6C, the lower surface of the clip pin 210 and the signal pad (not shown) of the circuit board P are in electrical contact with each other via elastic contact or soldering, and the lower surface 112*a* of the second portion 112 of the signal pin 110 is in elastic contact with the upper end of the clip pin 210. In addition, the signal line 310, the outer conductor 220, and the signal pin 110 are primarily shielded by the shield cans 120 and 130, secondarily shielded by the plug shell 150, and tertiarily shielded by the receptacle base 220 and the receptacle shell 240.

Figure 7A:
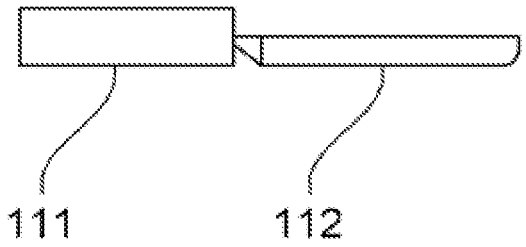
FIGS. 7A, 7B and 7C show modifications of a signal pin.
Figure 7B:
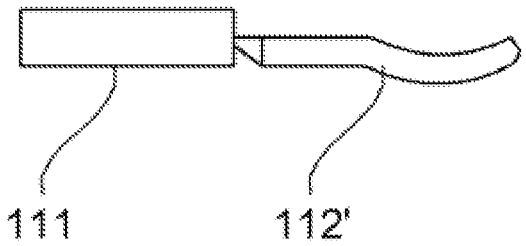
Figure 7C:
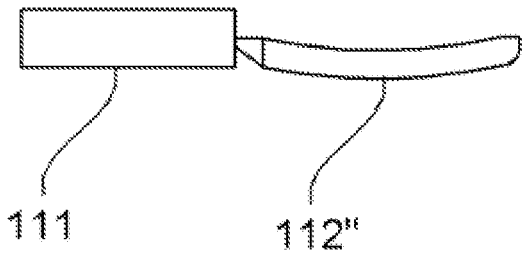

FIG. 7 shows modifications of the signal pin 110. The second portion 112 of the signal pin 110 may be formed in a straight line as shown in (a), but various modifications are possible. For example, as shown in (b), a part of a second portion 112' may be formed to be bent downward, or as shown in (c), a second portion 112" may be formed to be bent downward as a whole.

Figure 8A:
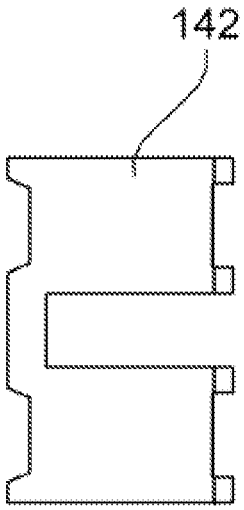
FIGS. 8A. 8B and 8C show modifications of a first insulating member.
Figure 8B:
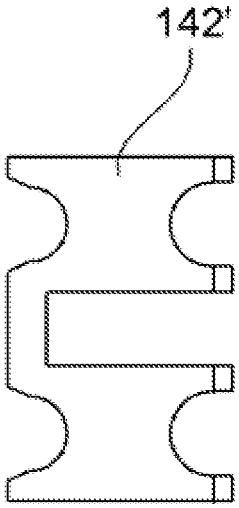
Figure 8C:
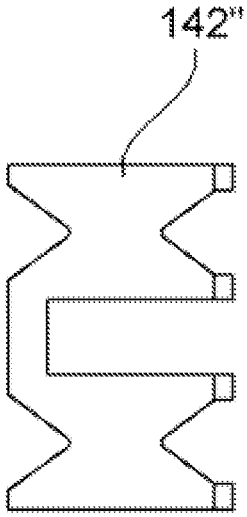

FIG. 8 shows modifications of the first insulating member 140. The first section 142 of the first insulating member 140 may be formed in a substantially rectangular shape when viewed from above as shown in (a), but various modification are possible. For example, as shown in (b), the front and rear sides of a first section 142' may be roundly recessed, or as shown in (c), the front and rear sides of the first section 142" may be angularly recessed.

Figure 9:
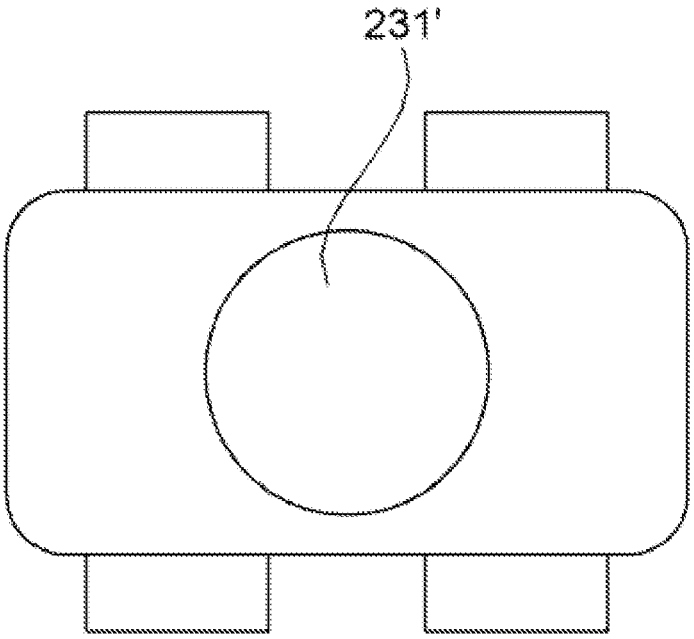
FIG. 9 shows modifications of a second insulating member.
Figure 10A:
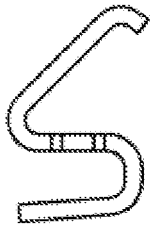
FIGS. 10A, 10B, 10C and 10D show modifications of a clip pin.
Figure 10B:
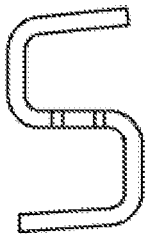
Figure 10C:
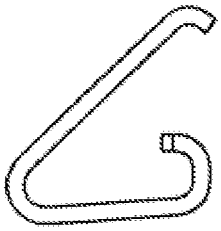
Figure 10D:
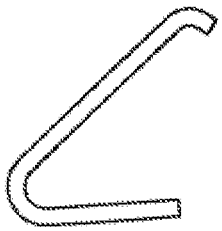

FIG. 9 shows modifications of the second insulating member 230. The through hole 231 of the second insulating member 230 may have a substantially rectangular shape as shown in FIG. 5, but various modification are possible. For example, as shown in FIG. 9, a through hole 231' may have a circular shape.

FIG. 10 shows modifications of the clip pin 210. In the embodiment of the present invention, the shape of the clip pin 210 is not limited to the shape as shown in (a), and various modifications are possible, such as shapes as shown in (b), (c), and (d) that allow the lower surface to be in contact with the signal pad of the circuit board P and allow the upper end to be in elastic contact with the lower surface 112*a* of the signal pin 110.

The connector assembly according to an embodiment of the present invention has a structure in which the plug connector is slidably inserted into the receptacle connector. Accordingly, the height of the connector assembly is minimized and a coupling copper wire of the plug connector is parallel to the circuit board, and thus it is advantageous in terms of reduction in size.

In addition, the connector assembly according to an embodiment of the present invention has excellent electromagnetic wave shielding performance and is advantageously capable of simultaneously connecting a plurality of cables and circuit boards.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A connector assembly comprising:

a receptacle connector; and a plug connector to be slidably inserted into the receptacle connector, wherein the plug connector comprises a signal pin having one side in electrical contact with a signal line of a cable, a shield can formed to enclose the signal pin so that a lower surface of the other side of the signal pin is exposed and to be electrically spaced apart from the signal pin, a first insulating member coupled to the signal pin to insulate between the signal pin and the shield can, and a plug shell enclosing the shield can so as to expose the lower surface of the other side of the signal pin, and wherein the receptacle connector comprises a clip pin having a lower portion formed to be in contact with a signal pad of a circuit board and an upper end formed to be in elastic contact with the lower surface of the other side of the signal pin, a receptacle base formed to be installed on the circuit board and providing a space in which the clip pin is accommodated, a second insulating member enclosing lateral surfaces of the clip pin to insulate between the clip pin and the receptacle base, and a receptacle shell covering the receptacle base to provide a space into which the plug connector is slidably inserted together with the receptacle base.

2. The connector assembly of claim 1, wherein the shield can comprises a lower shield can having a seating groove in which a lower portion of the cable is seated and an upper shield can having a seating groove in which an upper portion of the cable is seated and covering the lower shield can.

3. The connector assembly of claim 1, wherein the signal pin is provided in plural and arranged in parallel corresponding to a plurality of cables and the shield can includes a shielding wall to shield between adjacent signal pins.

4. The connector assembly of claim 1, wherein the signal pin comprises a first portion having an insertion portion into which the signal line is inserted on one side and a second portion integrally formed with the first portion and having the lower surface of the other side.

5. The connector assembly of claim 4, wherein the first insulating member has a through hole through which the second portion of the signal pin passes, and comprises a first section formed to cover an upper portion of the second portion and expose the lower surface of the other side while forming an upper portion of the through hole and a second section formed below the first section to be shorter than the first section to expose the lower surface of the other side while forming a lower portion of the through hole.

6. The connector assembly of claim 5, wherein the shield can comprises a lower shield can having a seating groove in which a lower portion of the cable is seated and a seating groove in which the first insulating member and the second insulating member are seated and an upper shield can covering the lower shield can and having a seating groove in which an upper portion of the cable is seated and a seating groove in which the first section of the first insulating member is seated.

7. The connector assembly of claim 1, wherein the plug shell, the receptacle base, and the receptacle shell are formed of a metal material.

8. The connector assembly of claim 1, wherein the plug shell comprises a wrapping portion that encloses and supports a portion of the cable exposed to the outside of the shield can.

9. The connector assembly of claim 1, wherein the plug shell has a coupling hole on an upper surface thereof and the receptacle shell has an elastic coupling portion, on an upper surface thereof, to be inserted into and coupled to the coupling hole.

10. The connector assembly of claim 1, wherein the receptacle shell has a coupling hole on a lateral surface thereof and the plug shell has a coupling projection, on a lateral surface thereof, to be inserted into and coupled to the coupling hole.

11. The connector assembly of claim 1, wherein the plug shell has a plurality of protruding portions on a lower surface thereof and the plurality of protruding portions are in close contact with an upper surface of the receptacle base.

12. The connector assembly of claim 1, wherein the second insulating member has holes on both lateral surfaces thereof and the clip pin has protruding portions, on both lateral surfaces thereof, to be inserted into the holes.

13. The connector assembly of claim 1, wherein the receptacle base has a space into which the second insulating member is inserted, the second insulating member has a protruding portion on a lateral surface thereof, and a receiving groove in which the protruding portion is accommodated is formed on a lateral side of the space.

* * * * *